US007669737B2

(12) United States Patent
Bethuy et al.

(10) Patent No.: US 7,669,737 B2
(45) Date of Patent: Mar. 2, 2010

(54) BEVERAGE DISPENSING SYSTEM WITH A HEAD CAPABLE OF DISPENSING PLURAL DIFFERENT BEVERAGES

(75) Inventors: Timothy W. Bethuy, New Fairfield, CT (US); William J. Black, Bethel, CT (US); Brian T. Cahill, Oak Creek, WI (US); Ronald Schilling, Waterford, WI (US); Paul Novotny, Saint Francis, WI (US); Fabio Nebbia, Giarole (IT); Giovanni Perucca, Casale Monferrato (IT)

(73) Assignee: Pepsico, Inc., Purchase, NY (US)

( * ) Notice: Subject to any disclaimer, the term of this patent is extended or adjusted under 35 U.S.C. 154(b) by 0 days.

(21) Appl. No.: 12/235,239

(22) Filed: Sep. 22, 2008

(65) Prior Publication Data

US 2009/0057342 A1 Mar. 5, 2009

Related U.S. Application Data

(62) Division of application No. 11/118,535, filed on Apr. 29, 2005.

(60) Provisional application No. 60/572,976, filed on May 21, 2004.

(51) Int. Cl.
*B67D 5/56* (2006.01)

(52) U.S. Cl. ..... 222/129.1; 222/132; 222/135; 222/144.5

(58) Field of Classification Search ..... 222/129.1, 222/129.3, 129.4, 144.5, 132, 135
See application file for complete search history.

(56) References Cited

U.S. PATENT DOCUMENTS

| | | | | |
|---|---|---|---|---|
| 3,853,244 | A | 12/1974 | Neumann | |
| 3,902,636 | A | 9/1975 | Zilk | |
| 4,712,591 | A | 12/1987 | McCann et al. | |
| 4,944,332 | A | 7/1990 | Belland | |
| 4,972,883 | A | 11/1990 | Hassell et al. | |
| 4,974,643 | A | 12/1990 | Bennett et al. | |
| 5,190,188 | A | 3/1993 | Credle, Jr. | |
| 5,228,486 | A | 7/1993 | Henninger | |
| 5,566,863 | A | 10/1996 | Mesenbring et al. | |
| 6,058,986 | A | 5/2000 | Bethuy et al. | |
| 6,286,721 | B1 | 9/2001 | Pellegrini | |
| 6,401,981 | B1 * | 6/2002 | McCann et al. | 222/129.1 |
| 6,684,920 | B2 | 2/2004 | Seitz | |

FOREIGN PATENT DOCUMENTS

| | | |
|---|---|---|
| WO | 90/11961 | 10/1990 |
| WO | 03/026966 | 4/2003 |

* cited by examiner

*Primary Examiner*—J. Casimer Jacyna
(74) *Attorney, Agent, or Firm*—Banner & Witcoff, Ltd.

(57) ABSTRACT

A beverage dispensing system includes a base to which a dispensing head is removably attached without additional fasteners. Beverage-forming liquids are supplied through a plurality of separate conduits in the base. Each base conduit has a normally closed valve that normally blocks fluid flow. The dispensing head has at least one passageway that receives liquid from an associated one of the base conduits. A projection associated with each dispensing head passageway opens the associated conduit valve to allow fluid flow from the base to the head. Dispensing valves in the dispensing head regulate the dispensing of the beverage. By selectively opening the dispensing valves, a plurality of beverages are formed from combinations of one or more liquids. A dispensing head includes an inlet opening and an outlet opening at each end of a passage extending through a body, the inlet opening having a smaller cross-sectional area than the outlet opening.

8 Claims, 8 Drawing Sheets

BEVERAGE DISPENSING SYSTEM WITH A HEAD CAPABLE OF DISPENSING PLURAL DIFFERENT BEVERAGES

REFERENCE TO EARLIER FILED APPLICATION

This application claims the benefit of U.S. Non-Provisional patent application Ser. No. 11/118,535, filed Apr. 29, 2005, which claims priority to U.S. Provisional Application No. 60/572,976, filed May 21, 2004. Each of these applications is entirely incorporated herein by reference.

BACKGROUND OF THE INVENTION

1. Field of the Invention

The present invention relates generally to beverage dispensing systems for dispensing beverages such as carbonated beverages. More particularly, the present invention relates to a beverage dispensing system with a dispenser head capable of dispensing plural beverages.

2. Description of the Related Art

Often, at restaurants or other locations, a beverage is formed from a mixture of a concentrate and water. Depending on the particular beverage being formed, the water may or may not be carbonated. An advantage of dispensing beverages in this form is that the concentrate containers and water supply typically occupy significant less space than is otherwise required to store the same volume of beverage in individual containers. Moreover, this dispensing equipment eliminates the need for an establishment to have to deal with the waste formed by the empty individual containers.

A typical beverage dispenser includes a head from which a nozzle extends. A pump is usually employed to force at least the concentrate to the head. Internal to the head are valves that regulate the discharge of concentrate and the water. In order to dispense a particular beverage, a control member associated with the head, such as a lever or a button, is actuated. A control circuit that monitors the state of the control member actuates the pump and selectively opens the valves to cause the simultaneous discharge of concentrate and water. The two liquids mix upon discharge and in a container to form the desired beverage. One such dispensing head and nozzle is disclosed in the U.S. patent application Ser. No. 10/412,681, BEVERAGE FORMING AND DISPENSING SYSTEM, filed Apr. 14, 2003, U.S. Patent Pub. No. 2004/0084475 A1, published May 6, 2004, incorporated herein by reference.

Known dispensing heads work reasonably well for the purposes for which they are designed. However, there is a limitation associated with the design of known dispensing heads. Each dispensing head can only discharge a single concentrate and water blended beverage. Consequently, if an establishment wants to provide a large variety of blended beverages, it is presently required to employ a dispensing unit that has a large number of dispensing heads; one for each beverage. These multi-headed dispensing units occupy a significant amount of counter space. At some establishments, providing counter space needed for large-sized dispensing units significantly reduces space that may be desirable or required for other uses. Consequently, given the potential loss of counter space, sometimes establishments do not offer its patrons the variety of beverages that it could otherwise offer.

Moreover, some beverages are formed from base components that are only marginally different from the components forming other beverages. For example, there is an increasing consumer demand for lightly carbonated beverages. These beverages are formed from water that is less carbonated than the water used to form traditional soda-type soft drinks. For both technical reasons and space reasons, it has proven difficult to provide a beverage dispensing unit with carbonation equipment that can essentially simultaneously provide streams of carbonated water in which the levels of carbonation are different. This is why, to date, it has not been practical to provide a dispensing unit that is able to provide both highly carbonated and lightly carbonated beverages.

It has further been noted that the conventional nozzle assemblies include a rather cumbersome arrangement of numerous apertures in several discs or plates, defining plural chambers. The apertures are spaced apart and not aligned, thereby providing a baffle arrangement for fluid flow therethrough, and as a result, this baffle configuration reduces the amount of the pressure of the carbonated water as it passes through the nozzle. In some examples, the non-carbonated water pressure is reduced from about 80 p.s.i. to atmospheric pressure. Under normal conditions, sudden depressurization of the carbonated fluids can cause undesirable excessive frothing, sometimes referred to as carbonation breakout. One or more baffle arrangements is provided so as to reduce pressure of the carbonated water in several stages. However, manufacturing and assembly of the several disks required to assemble a multi-stage baffle configuration are somewhat cumbersome, and a more efficient method of depressurizing, perhaps also accommodating for multiple sources of different base components, has been found to be desirable.

Similarly, different beverages are formed from concentrates that are only slightly different from each other. For example, customers are increasing interested in enjoying beverages that include a supplemental flavor in addition to a base flavor. One popular supplemental flavor is cherry. For example, some consumers enjoy cola-flavored beverages with cherry flavoring and others lemon lime-flavored beverages with cherry flavoring. In presently known dispensing units, in order to provide customers with different beverages, and the supplemental-flavored versions of these beverages, it is necessary to provide a dispensing head for each of these beverages. As discussed above, this results in providing a counter-top assembly that is very large. Moreover, this would also require a large volume of behind-the-counter space in order to store the different types of concentrate that are required.

SUMMARY OF THE INVENTION

This invention relates to new and useful beverage dispensing systems. More specifically, the beverage dispensing system of this invention includes a beverage dispensing head through which multiple beverage-forming liquids can be discharged. The discharge of each liquid is regulated by a separate valve internal to the head. By selectively actuating the valves, different combinations of beverage-forming liquids are discharged to form different beverages.

Another feature of the dispensing system of this invention is that the head simultaneously discharges both non-carbonated and carbonated water. Thus, this invention can form a beverage that, in comparison to traditional soft drinks, is lightly carbonated.

Still another feature of this invention is that it makes it possible to simultaneously discharge, from a single dispensing head, different blends of concentrate. For example, the single dispensing head of this invention can discharge a pure concentrate of a soda or the soda concentrate and a second, supplemental flavor concentrate. Thus, the single dispensing head of this invention discharges flavored beverages that are combinations of concentrates.

It is another feature of this invention to provide a dispensing head with a nozzle designed to minimize the carbonation breakout, the release of the $CO_2$, which occurs upon the discharge of carbonated water.

It is another feature of the present invention to provide for a more elegant, simpler to assemble, improved method for gradually reducing the pressurization of one or more base components, for example, carbonated water, while minimizing the carbonation breakout.

A further feature of this invention is to provide a dispensing head that is easy to remove from, and reinstall to, the base unit with which it is associated and that the removal of the dispensing head does not cause leakage of the beverage forming ingredients.

An additional feature of the dispensing system of this invention is that, after installation, the system can supply beverages formed from combinations of one or more different liquids without having to extensively reconfigure the system's internal fluid supply lines.

DETAILED DESCRIPTION OF THE PREFERRED EMBODIMENT

Figure 1:
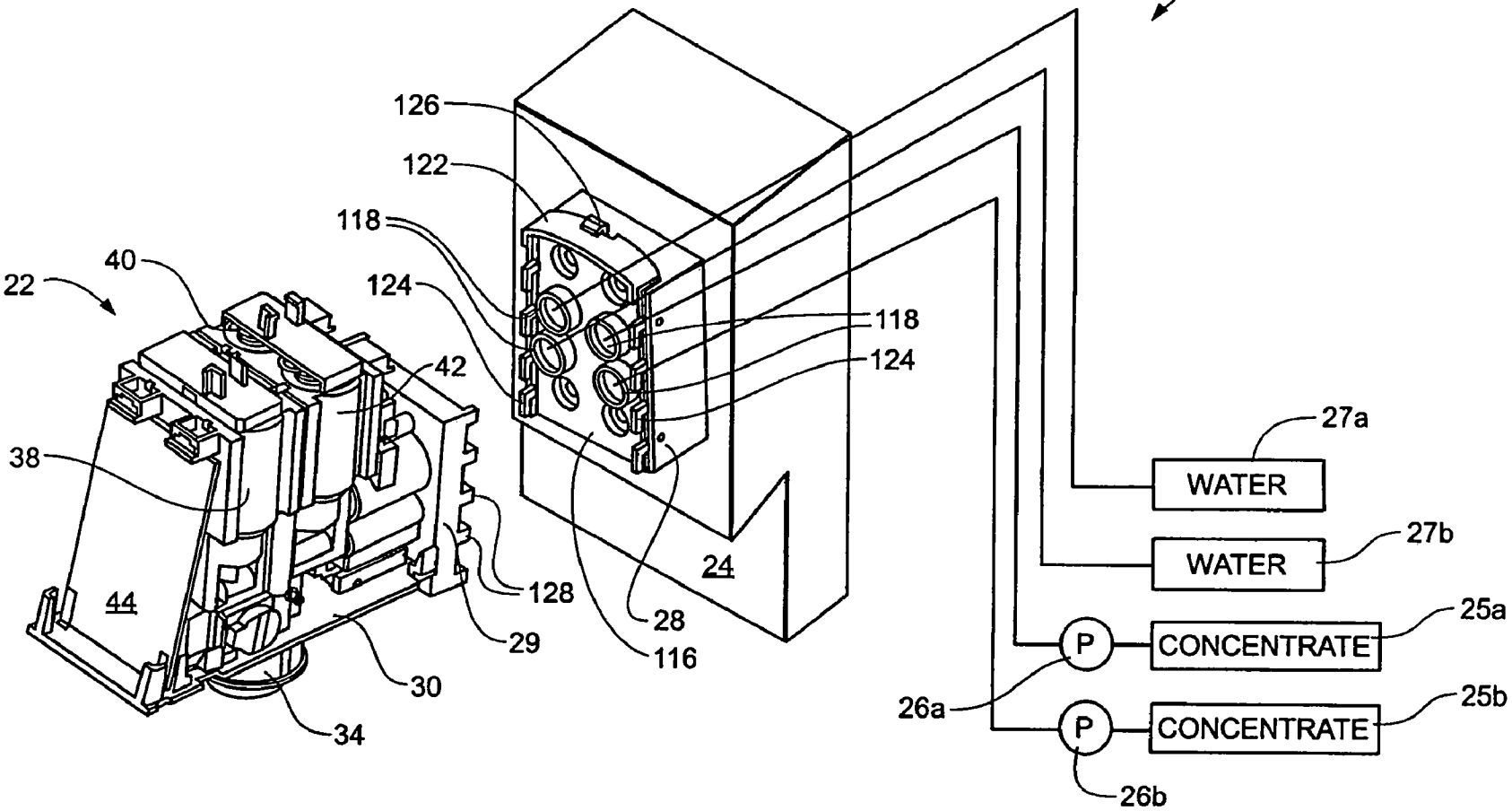
FIG. 1 is an exploded view and schematic diagram of the dispensing system and dispensing head of this invention.

FIG. 1 illustrates a dispensing system 20, including a dispensing head 22, according to this invention, and a counter-located base 24, to which the dispensing head 22 is removably mounted. Different flavored concentrates, sometimes called syrups, are stored in containers or reservoirs 25*a* and 25*b* that are typically concealed from the user who is dispensing the beverages. Pumps 26*a* and 26*b* are connected to each concentrate container 25*a* and 25*b*, respectively. Each pump 26*a* and 26*b* pumps the associated concentrate through the base 24 and into the dispensing head 22. Two sources of water, represented by blocks 27*a* and 27*b*, are also connected to base 24. One source supplies a noncarbonated water stream. The second source includes a carbonator (not illustrated) that supplies carbon dioxide to the water stream it supplies through base 24 into the dispensing head 22.

The tubing (shown schematically, but not otherwise identified) through which these four fluid streams flow into the base 24 terminates at a mounting block 28. Mounting block 28 is the component of the base 24 to which the dispensing head 22 is removably mounted.

Dispensing head 22, now further described by reference to FIGS. 1-3, includes a vertical back plate 29 from which a base plate 30 extends horizontally. Back plate 29 is the component of the dispensing head 22 that is removably coupled to dispensing unit mounting block 28. A valve body 32 is seated on the base plate 30. A nozzle assembly 34 extends below the base plate 30. Valve body 32 is formed with a number of conduits through which the concentrate and water streams flow into the nozzle assembly 34. In this embodiment of the invention, four separate fluid streams are delivered from the dispensing unit base 24 to the dispensing head 22, as shown. These comprise two concentrate streams, a stream of noncarbonated water, and a stream of carbonated water.

Four valve units, 36, 38, 40 and 42, are mounted to the valve body 32. Each valve unit 36-42 regulates the flow of a separate one of the fluid streams through the dispensing head 22 and out of the nozzle assembly 34.

A circuit board 44 is mounted to the base plate 30 so as to be located forward of the two most forward valve units, valve units 36 and 38. Circuit board 44 carries the electrical components (not illustrated) that are used to regulate the actuation of pumps 26*a* and 26*b* (FIG. 1) and valve units 36-42. Not shown are the electrical connectors that extend between the dispensing system base 24 and the dispensing head 22. These are the connectors over which energization signals are provided to the valve units 36-42, control signals are provided to the pumps 26*a* and 26*b*, and feedback signals are supplied from the dispensing head 22 to the dispensing system 20. A cover (not illustrated), normally extends over the internal components of the dispensing head 22.

The valve body 32 is formed with a number of horizontal conduits through which the fluid streams flow from mounting block 28 (FIG. 1) into dispensing head 22. Specifically, there are two parallel lower horizontal conduits 48 (one shown). Each lower horizontal conduit 48 extends forward from a boss 50 (one shown) that extends rearwardly from the main body of valve body 32 through an opening in the back plate 29 (back plate opening not identified.) Throughout this application, "forward" is understood to be toward the leading edge of the dispensing head base plate 30. "Rearward" is understood to be away from leading edge of the dispensing head base plate. Each lower horizontal conduit 48 extends across substantially the whole of the length of the valve body 32.

Valve body 32 is further formed to have two parallel vertically extending valve inlet passages 51 (one shown). Each lower horizontal conduit 48 terminates at a separate one of the valve inlet passages 51. Each valve inlet passage 51 opens into a discharge chamber 52 (one shown) also formed in the valve body 32. While not illustrated, it is appreciated from the aforementioned commonly invented U.S. patent application Ser. No. 10/412,681, published as U.S. Patent Pub. No. 2004/0084475, that a discharge conduit extends from each discharge chamber 52 to the nozzle assembly 34.

A first one of the valve units, valve unit 36, regulates fluid flow from a first one of the valve inlet passages 51 to the associated discharge chamber 52. A second valve unit, valve unit 38 (FIGS. 1 and 2), regulates fluid flow from the second one of the valve inlet passages 51 to the second discharge chamber 52. Specifically, as seen in FIG. 3 with respect to valve unit 38, each of the valve units 36 and 38 are mounted in a separate valve bore 54 formed in the valve body 32. Each valve bore 54 is coaxially aligned with the valve inlet passage 51 with which the bore is associated. Each valve unit 36, 38 includes a solenoid 56 that is capable of retracting a plunger 58. At the head of the plunger 58 is a valve member (not illustrated). A spring (not illustrated) may hold the plunger 58 in the extended state so that the valve member presses against the open end of the valve inlet passage 51. Upon activation of the solenoid 56, the plunger 58 and valve member retract to allow fluid to flow upwardly from the valve inlet passage 51 and into the associated discharge chamber 52.

Figure 2:
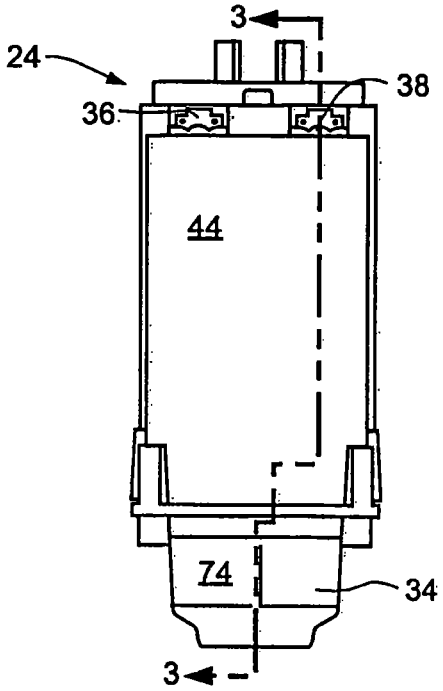
FIG. 2 is plan view of the front of the dispensing head.
Figure 3:
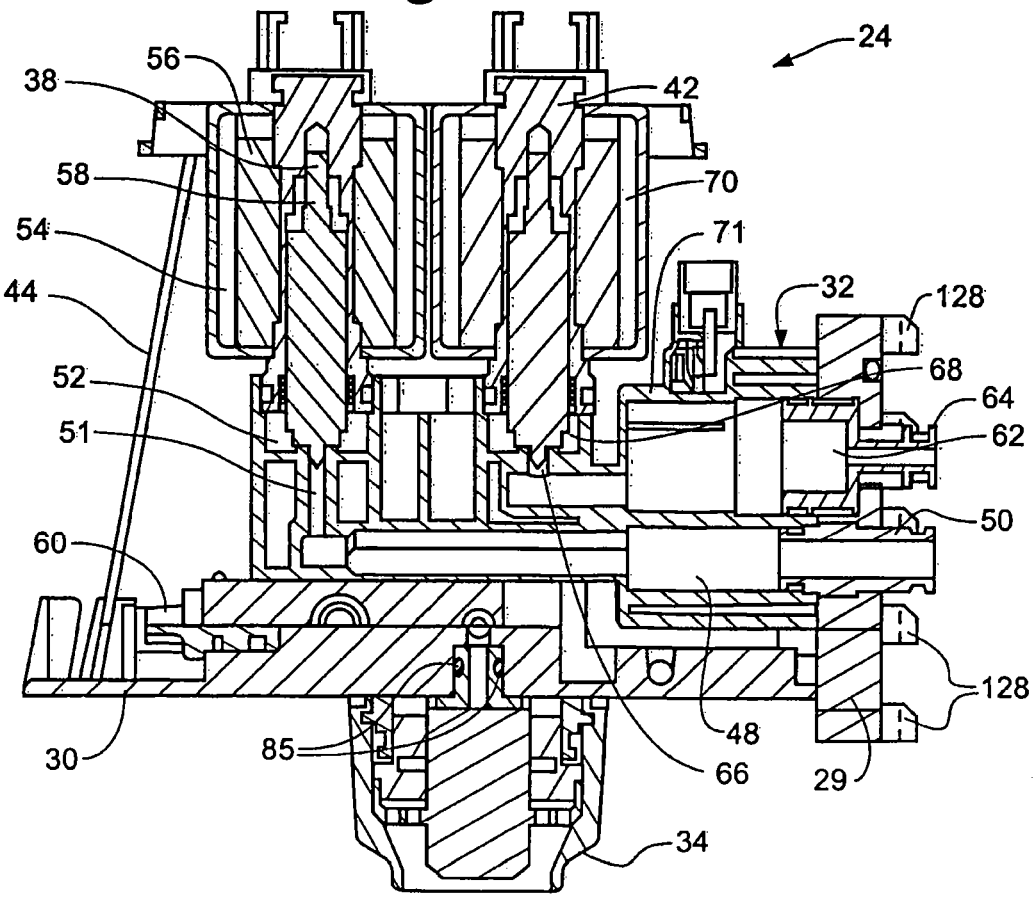
FIG. 3 is a cross-sectional view of the dispensing head taken along line 33 of FIG. 2.

In an embodiment of the invention, illustrated in FIGS. 1-3, two temperature sensors, such as thermistors 60 (one shown), are mounted to the valve body 32. Each thermistor 60 is positioned so that the temperature sensitive head is located in a separate one of the discharge conduits. The thermistors 60 provide an indication of the temperature of the discharged concentrate to the circuit used to control beverage discharge. Specifically, this circuit uses the temperature data to monitor and regulate the water-to-concentrate ratio of the discharged beverage.

Valve body 32 is further formed to have two parallel upper horizontal conduits 62 (one shown). Each upper horizontal conduit 62 extends forward from a rearwardly extending boss 64 (one shown) formed integrally with the valve body 32. Bosses 64, like bosses 50, extend rearwardly beyond the back plate 29. In the described embodiment of the invention, bosses 64 are closer together than bosses 50. A vertical valve inlet passage 66 extends into the closed end of each upper horizontal conduit 62. In the embodiment of the invention depicted in FIG. 3, the valve inlet passages 51 associated with the lower horizontal conduits 48 are longer than the valve inlet passages 66 associated with the upper horizontal conduits 62. In some versions of the invention, the valve inlet passages 51 and 66 may have a similar or identical length, or the relative lengths of the valve inlet passages 51, 66 may be reversed.

As seen in FIG. 3 with respect to valve 42, each valve inlet passage 66 opens into a separate discharge chamber 68 also formed in the valve body 32. While not illustrated, it is recognized that valve body 32 is further formed to have two separate discharged conduits, one that extends from each discharge chamber 68, to the nozzle assembly 34.

A third one of the valve units, valve unit 40 (FIG. 1), regulates fluid flow between a first one of the valve inlet passages 66 and the associated discharge chamber 68. The remaining valve unit, valve unit 42, regulates fluid flow between the remaining valve passage 66 and the discharge chamber 68 associated therewith. Each valve unit 40 and 42 is seated in a separate valve bore 70, seen in FIG. 3 with respect to valve unit 42, that is, coaxial with a separate one of the valve inlet passages 66. Valve units 40 and 42 have the same components as and function in the same manner as the previously-described valve units 36 and 38. A retaining plate 71 holds the valve units 36-42 to the valve body 32.

Nozzle assembly 34 of this invention, as seen by reference to FIGS. 2 and 5-8, includes nozzle cover 74 that is generally tubular in shape. Internal to the nozzle cover 74 is a ring shaped water head 76. Disposed in the center of the water head 76 is a generally solid and cylindrical syrup head 78.

Figure 6:
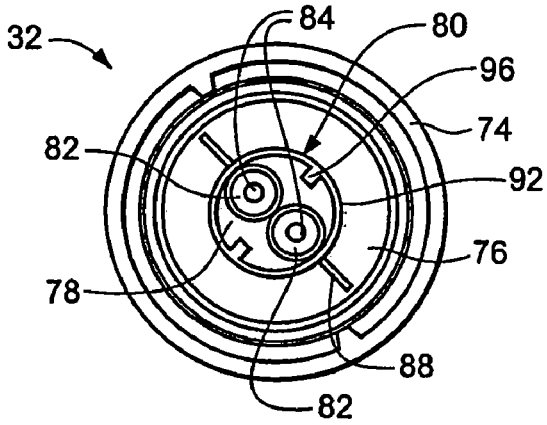
FIG. 6 is a top view of the nozzle assembly shown in FIG. 5.

Syrup head 78, now described by reference to FIGS. 6 and 8, includes a generally solid main body 80. Syrup head main body 80 is the circular component of the syrup head 78 seated inside the water head 76 and disposed concentrically therewith. Extending upwardly from the main body 80, syrup head 78 has two parallel, cylindrically shaped stems 82. Syrup head 78 is formed so that a bore 84 extends axially through each stem 82 and the section of the main body 80 coaxial with the stem. When the dispensing head 22 is assembled, each stem 82 seats in the valve body opening of a separate one of the discharge conduits that extend from the valve chambers 52. An O-ring 85 is fitted around the upper end of each stem 82. Each O-ring 85 is seated in a complementary groove (not identified), as shown, formed in the associated stem 82. The O-rings 85 form liquid-tight seals around the stems 82, when the nozzle 34 is assembled to extend into the base plate 30, see FIG. 3.

Figure 9:
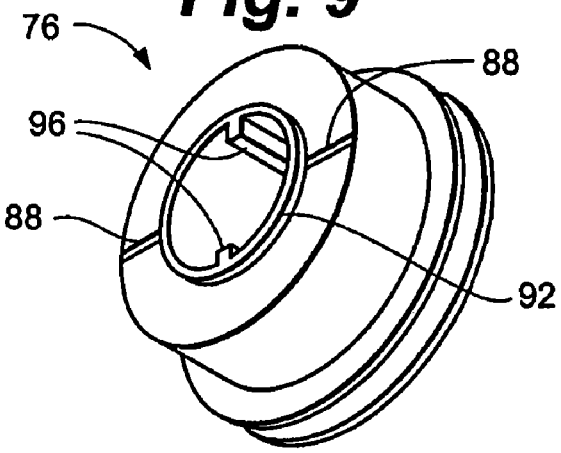
FIG. 9 is a perspective view of the water head illustrating the inner face of the water head.
Figure 10:
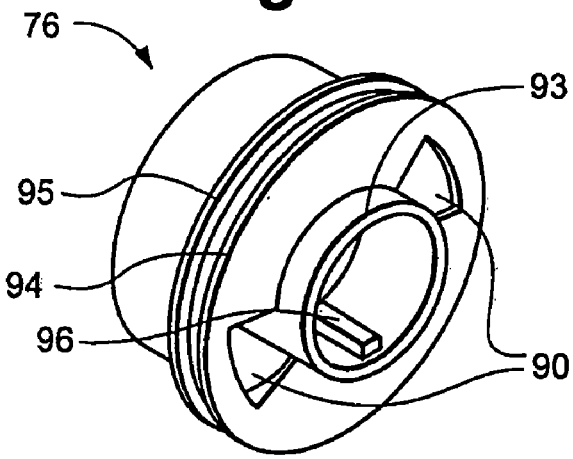
FIG. 10 is a perspective view of the water head illustrating the outer face of the water head.
Figure 11:
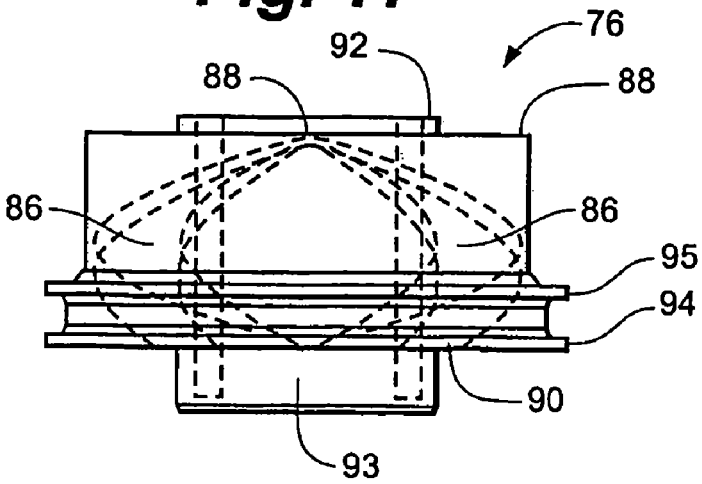
FIG. 11 is a side view of the water head.

The water head 76, as seen in FIGS. 9-11, is generally in the form of a solid ring. Water head 76 is, however, formed with two diametrically opposed discharge passages 86. Each discharge passage 86 is formed to have a generally rectangular cross-sectional profile. The cross-sectional area, that is, the width, of each discharge passage 86 increases in the direction that extends away from the opening into which fluid enters the passage. Thus, as seen by reference to FIGS. 9 and 10, each discharge passage 86 has a narrow sized inlet opening 88 and a wide outlet opening 90. Although shown having two oppositely disposed passages 86, any number of passages may be used. If more than one passage extends from the water head 76, the passages may be circumferentially equally disposed from each other. For example, three passages would be disposed 120° from each other, four passages 90° from each other, etc.

As best seen by reference to FIG. 11, wherein the discharge passages 86 are shown in phantom, each passage 86 is shaped so that, as the passage extends away from its inlet opening 88, the height of the passage increases. This translates into the cross-sectional area of the passage also becoming larger as the fluid travels along the passage from inlet to outlet. In the depicted embodiment of the invention, each passage 86 extends/surrounds 180° around the body of the water head 76 in a helix. Accordingly, the inlet opening 88 of each discharge passage 86 is immediately above the outlet opening 90 of the other discharge passage.

Water head 76 is further formed to have a first annular lip 92 that extends upwardly from the main body of the head and around the annular center space defined by the head. A second annular lip 93 extends from the opposite side of the water head 76 in a direction opposite to the direction in which lip 92 extends. Two circular parallel, spaced apart circular flanges 94 and 95 extend outwardly from the main body of water head 76 immediately above lip 93.

The water head 76 is also shaped to have two diametrically opposed ribs 96. Each rib 96 projects into the annular space defined by the water head and extends from lip 92, across the main body of the head 76, to lip 93. Ribs 96 are dimensioned to effect a compression fit between the water head 76 and the syrup head main body 80, when the water head 76 is assembled in the syrup head main body 80. Alternatively, a non-toxic adhesive may be used to further cement the two elements to each other.

Figure 7:
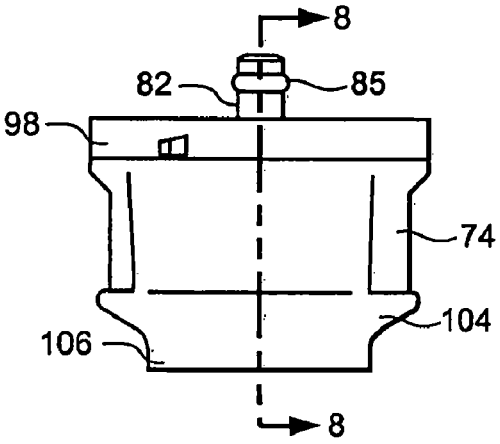
FIG. 7 is a side view of the nozzle assembly shown in FIG. 5.
Figure 8:
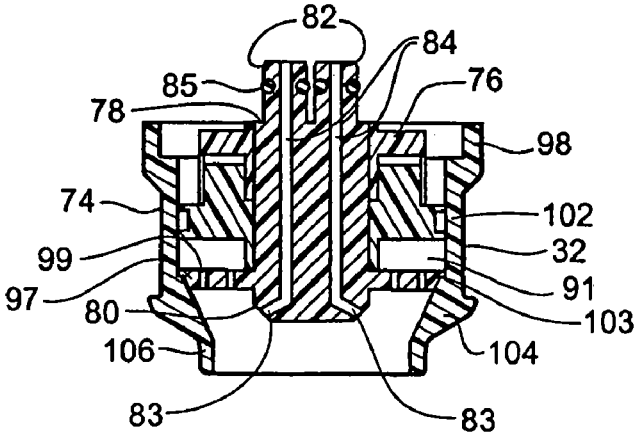
FIG. 8 is a cross-sectional view of the nozzle assembly taken approximately along line 8-8 of FIG. 7.

As illustrated in FIGS. 7 and 8, nozzle cover 74 has a base 98 that is the section positioned adjacent to base plate 30 and the nozzle cover 74 makes contacts therewith, as shown in FIG. 3. Base 98 is the section of the nozzle cover with the widest outer diameter. Extending downwardly from base 98, nozzle cover 74 has a relatively long main section 102 with constant inner and outer diameters. Extending inwardly from the inner surface of main section 102 are diametrically opposed ribs 103, which facilitate the compression assembly of nozzle assembly 34.

Extending downwardly from main section 102, the nozzle cover 74 has a neck 104. The nozzle cover 74 is formed so that the neck 104 has an inner diameter that tapers inwardly relative to the adjacent constant diameter surface of cover main section 102. A circular head 106 forms the free end of nozzle cover 74. Head 106, which extends downwardly from neck 104, also has both constant inner and outer diameters.

When the dispensing head 22 of this invention is assembled, the water head 76 is positioned so that the outlet openings 90 open into the widest diameter space within the nozzle main section 102. The outlet openings 90 open into a decompression chamber 91 defined by the water head 76, the walls of the main section 102 and an annular disk 97 having plural apertures 99, and flow from the chamber 91 and into the space defined by neck 104. The syrup head main body 80 extends below the outer face of the water head 76 and into the space defined by the surrounding neck 104. Syrup head bores 84 thus open into the nozzle cover 74 below, and forward of, the water head outlet openings 90. Preferably, the bores 84 include angled discharge opening 83, as shown, that deflect the stream of syrup flow discharged from the syrup head 78.

Figure 12:
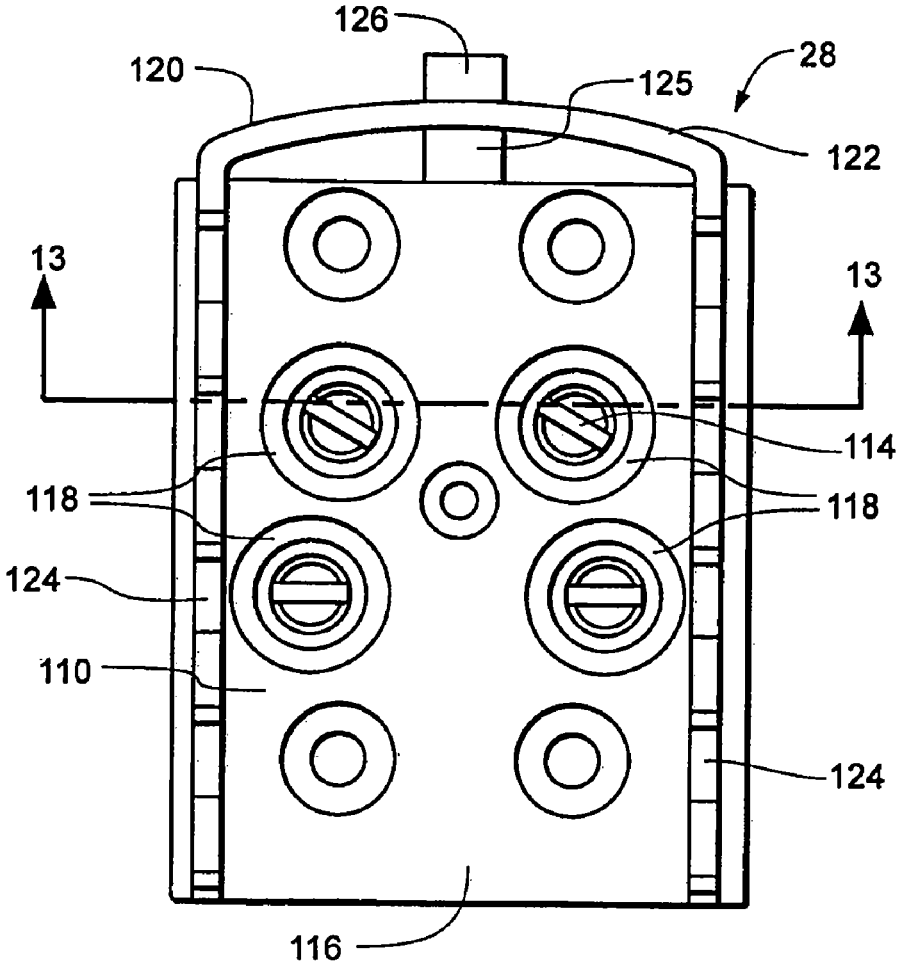
FIG. 12 is a plan view of the front of the dispensing unit mounting block.
Figure 13:
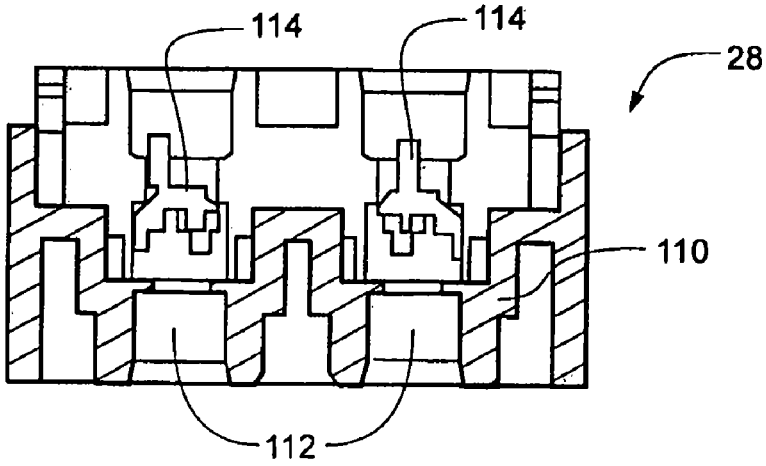
FIG. 13 is a cross-sectional view of the mounting block taken along line 13-13 of FIG. 12.
Figure 14:
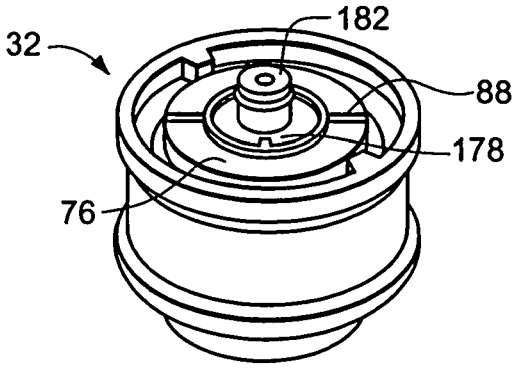
FIG. 14 is a perspective view of an alternate embodiment of the nozzle assembly.
Figure 15:
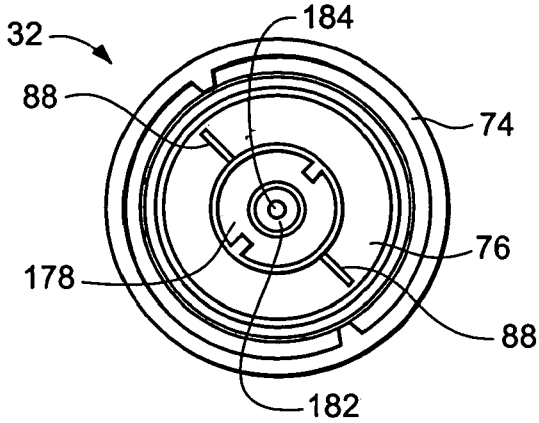
FIG. 15 is a top view of the nozzle assembly shown in FIG. 14.
Figure 16:
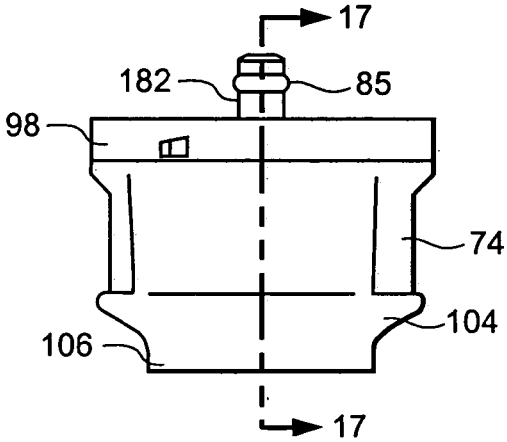
FIG. 16 is a side view of the nozzle assembly shown in FIG. 14.
Figure 17:
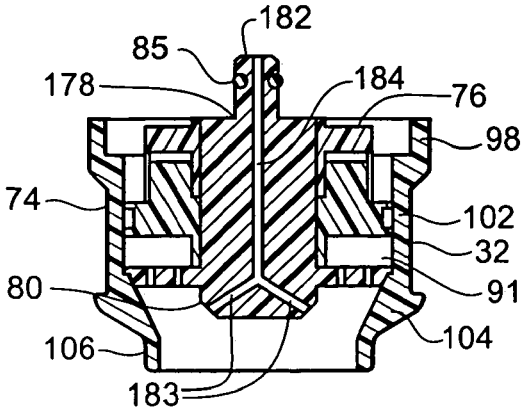
FIG. 17 is a cross-sectional view of the nozzle assembly taken approximately along line 17-17 of FIG. 16.

Mounting block 28 is described below by reference to FIGS. 1, 12 and 13, and includes a main body 110. Internal to the main body 110 are four passageways 112 (two shown) through which the individual fluid streams flow. A poppet valve 114 is seated in each passageway 112. In the absence of the dispensing head 22 being coupled to the mounting block 28, the poppet valves 114 prevent fluid from flowing out of the passageways 112. The mounting block 28 has a front face 116 that is the surface of the block into which passageways 112 open. Four rings 118 are integrally formed with and extend forward from the block front face 116. Each ring 118 is centered around a separate one of the openings of the passageways 112.

A U-shaped lock plate 120 is slidably attached to the mounting block main body 110. More particularly, the opposed sides of lock plate 120 are slidably mounted in grooves formed along the outer side perimeters of the mounting block main body 110 (grooves not identified). Lock plate 120 has a cross bar 122 that connects the side sections, that is, extends over the mounting block main body 110. The lock plate 120 is formed with downwardly directed, L-shaped hooks 124 that extend forward from the sides of the lock plate. Each side of lock plate 120 is provided with plural, longitudinally spaced apart hooks 124, as shown in FIG. 1.

A flexible finger 125 normally latches lock plate 120 in the locked state. Specifically, finger 125 extends upwardly from the top of the mounting block main body 110. Finger 125 is formed with a tip section 126 shaped to extend over the lock plate cross bar 122.

The lock plate hooks 124 engage complementary members formed on the dispensing head back plate 29. More particularly, L-shaped hooks 128 extend rearwardly from the opposed side edges of back plate 29. Back plate 29 is formed so that the free ends of the hooks 128 on the opposed sides of the plate are directed inwardly toward each other.

In order to couple the dispensing head 22 to mounting block 28, finger 125 is retracted away from cross bar 122 so lock plate 120 can be slid upwardly. This may be facilitated by tip section 126, which is accessible and when depressed, also transposes the finger 125. Dispensing head 22 is then fitted to the mounting block 28 by inserting bosses 50 (FIG. 3) into the lower of the two rings 118 and passageway 112 openings and bosses 64 into the upper of the two rings 118 and passageway 112 openings. Lock plate 120 is then pressed downwardly so that the lock plate hooks 124 engage the back plate hooks 128. The downward movement of the lock plate 122 causes finger tip 126 to snap over the lock plate cross bar 122 to hold the lock plate 120 in position. Lock plate hooks 124 engage back plate hooks 128 to hold the dispensing head 22 to mounting block 28.

As a consequence of the dispensing head bosses 50 and 64 extending into mounting block passageways 112, the bosses push the poppet valves 114 open by displacing the closures away from the passageway-defining surfaces against which the valves seat. This displacement moves the valves 114 to the open positions in passageways 112. Fluid streams are thus able to flow from the mounting block 28 into the dispensing head 22.

Referring again also to FIG. 3 of this embodiment of the invention, two separate concentrate fluid streams flow through the individual mounting block lower passageways 112. Each of these fluid streams flows into a specific one of the lower horizontal conduits 48 formed extending through the valve body 32. Valve units 36 and 38 each regulate the discharge of fluid from a separate one of the conduits 48 out of the dispensing head 22 and the associated syrup head bore 84, which extends through the nozzle assembly 34 (not illustrated in FIG. 3). The carbonated and non-carbonated water streams flow through the separate mounting block upper passageways 112. Each of these fluid streams flows into a separate one of the upper horizontal conduits 62. Valves 40 and 42 regulate the fluid flow from each upper horizontal conduits 62, and permits its discharge out of the associated water head discharge passage 86.

The dispensing system 20 of this invention includes a single dispensing head 22 with plural passageways 48 through which concentrate flows. Valve units 36 and 38 operate independently from each other and preferably can be independently controlled. Thus, the system 20 of this invention is constructed so that a single dispensing head can be used to discharge beverages blended from any one of two or more distinct concentrates. This eliminates the need to provide the system 20 with multiple dispensing heads wherein each head is employed to dispense a single beverage.

It is further appreciated that valves 36 and 38 may be simultaneously opened. This makes it possible to discharge a beverage that is a desirable mixed blend of both concentrates.

Moreover, when concentrate is discharged from syrup head 78 (FIG. 6), substantially all of the concentrate is discharged in a downwardly directed fluid stream. Few, if any, concentrate drops adhere to the nozzle assembly 34 after discharge. This feature of the invention essentially eliminates the possibility that concentrate discharged in one dispensing operation will blend into the beverage dispensed in an immediate next dispensing operation to produce an undesirable flavor carry-over.

Alternatively, as shown in FIG. 8, the bores 84 are diverted into angled outlets 83, so that the fluid stream of the concentrate is injected at least partially in a lateral direction. This causes the concentrate to flow into, and become entrained in, the downwardly flowing base liquid, for example, carbonated water, that is discharged from the water head 76, to thereby generate a better blended beverage.

Another feature of the dispensing system 20 of this invention is that the head 22 receives and selectively discharges separate streams of carbonated and noncarbonated water from separate containers, for example, reservoirs 25*a*-25*d*. A benefit gained by this feature of the invention is that it likewise increases the options for dispensing multiple beverages from a single dispensing head 22. For example, the dispensing head 22 can be employed to dispense beverages selectively made from a single concentrate and carbonized or non-carbonized water. Similarly, in the four fluid stream, four valve embodiment of the invention, the single dispensing head can be used to dispense a first beverage that is a blend of a first concentrate and carbonated water and second beverage that is blend of a second concentrate and non-carbonated water.

Alternatively, valve units 40 and 42 may be opened simultaneously to cause the simultaneous dispensing of both carbonated and non-carbonated water. This is useful when it is desired to blend these two liquids with a concentrate to produce a lightly carbonated beverage. It should of course be appreciated that, in this method of operating the invention, each valve unit 40 and 42 may not always be opened simultaneously. By varying the amount of time each valve unit 40 and 42 is open relative to the other, the extent to which the water supplied for the beverage may be set anywhere between fully carbonated (100% carbonated water supply) to no carbonation (100% non-carbonated water supply.)

Dispensing head 22 of this invention is further designed so that the passage 86 from which the carbonated water is discharged has a tapered increase in cross-sectional area along its length as measured starting from the top to the bottom. That is, the passage 86 is very narrow at the high pressure end and widens considerably, to as much as ten times its width at the low pressure end adjacent the chamber 91. Consequently, as the water and gas fluid stream flows through this passage 86, the pressure of the gas bubbles in the stream decreases continually but gradually. This gradual decrease in pressure reduces the extent the carbon dioxide, upon the discharge from outlet opening 90, breaks out of the fluid stream. The reduction of carbonation breakout serves to ensure that the blended beverage has sufficient gaseous-state carbon dioxide to impart a desirable taste.

The poppet valves 114 internal to passageways 112 prevent flow out of the mounting block 28 unless the dispensing head 22 is connected to the base 24. Lock plate 120 and finger 125 provide a convenient means for holding the dispensing head 22 to the mounting block 28. This assembly does not include any supplemental fasteners, such as screws or nuts, to hold the dispensing head 22 to the mounting block 28. Thus, the dispensing system 20 of this invention is designed so that one can disconnect and reattach the dispensing head 22 to the mounting block 28 without requiring additional tools, such as screwdrivers or wrenches. Collectively, these features make it a relatively simply task to remove the dispensing head 22 for cleaning, repair, or replacement.

Figure 4:
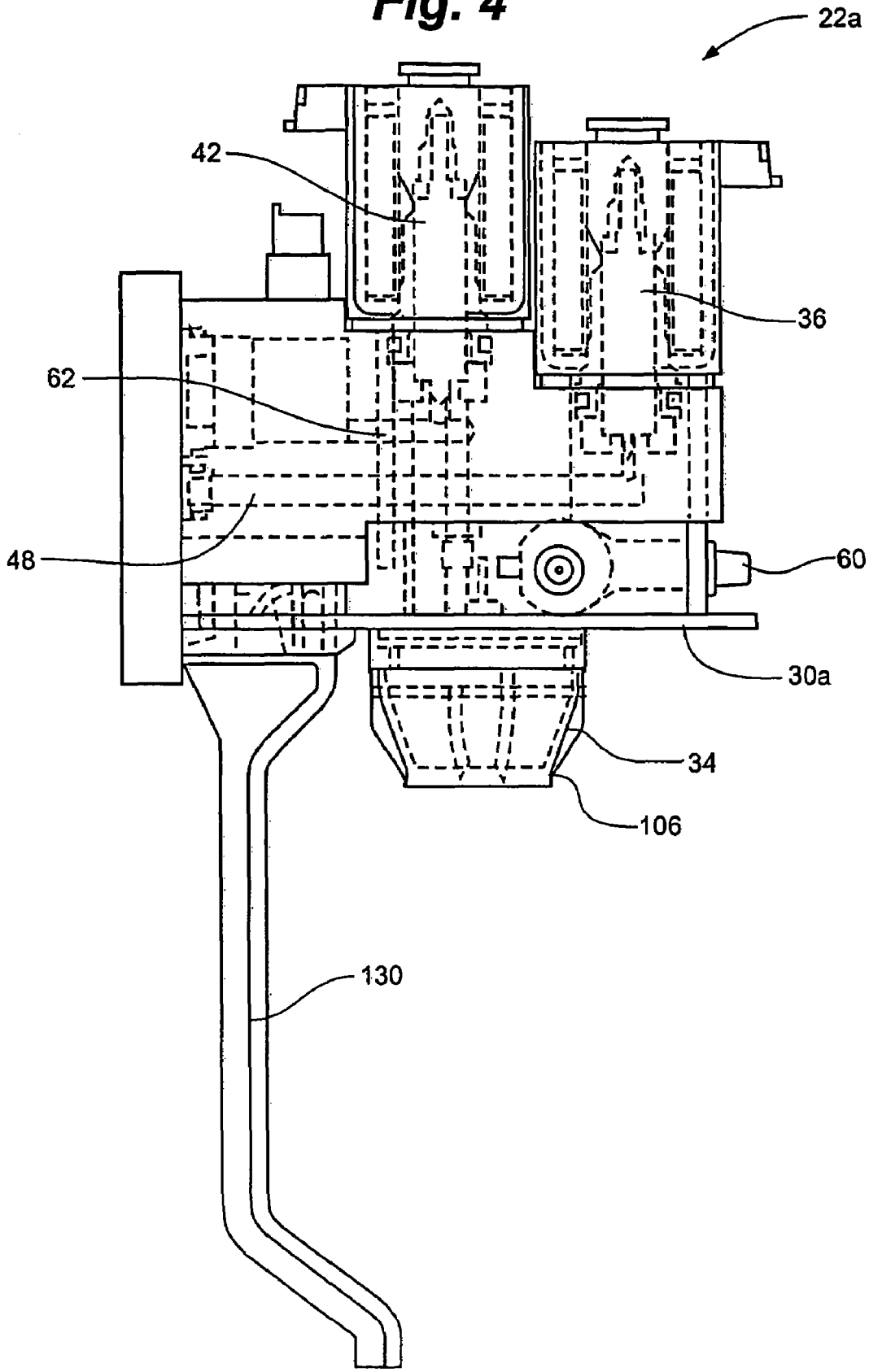
FIG. 4 is a cross-sectional view of an alternative construction of the dispensing head.
Figure 5:
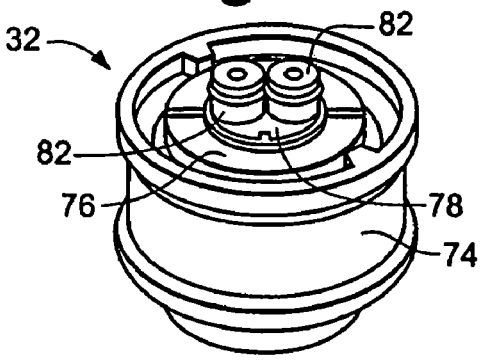
FIG. 5 is a perspective view of the nozzle assembly.

It should be recognized that the above description is directed to one embodiment of the invention. Other embodiments of the invention and variations or alterations thereof may have features different from those which have been described. For example, as illustrated in FIG. 4, a dispensing head 22*a* of this invention may be provided with a lever 130. Lever 130 is pivotally attached to base plate 30*a*. Lever 130 is shaped so that at least a portion of the lever is located immediately under the open-ended nozzle cover head 106. Thus, the act of positioning a container under the nozzle assembly 34 in order to file the container with a beverage causes lever 130 to pivot slightly. A switch (not illustrated), mounted to base plate 30*a*, is employed to monitor the pivotal state of lever 130. The state of the switch is monitored by the control circuit to regulate the discharge of the beverage from the dispensing head 22*a*.

Similarly, an alternative means may be employed to releasably hold the dispensing head 22 to the mounting block 28. In one such alternative assembly, the dispensing head may be provided with posts that extend rearwardly from the back plate 29. The posts seat in complementary bores formed in the mounting block 28. A lock plate is slidably disposed in the mounting block and held in a latched position by a spring. The seating of the posts in the complementary bores causes the displacement of the lock plate. Once the posts are seated and extend a sufficient distance into the bores, the spring forces the lock plate into grooves formed around the outer surfaces of the posts. The seating of the lock plate holds the posts, and therefore the dispensing head 22, to mounting block 28. In order to release the lock plate, it may be necessary to rotate a cam that causes the slidable displacement of the lock plate away from the posts. By appropriately shaping the mounting block lock plate and the dispensing head posts, one could insert and lock the dispensing head 22 to the mounting block 28 in a single, one-handed motion.

Also, the moveable locking member that releasably holds the dispensing head 22 to the mounting block 28 may be attached to the dispensing head. In these versions of the invention, the locking member would engage a member integral with the mounting block 28.

In some versions of the invention, the circuit board, on which the components used to regulate pumps 26*a* and 26*b* and valve units 36-42 are located, may also function as the retaining plate 71.

It should further be appreciated that not all versions of the invention have all of the above-described features. It may be desirable, for example, to provide an embodiment of this invention having a single passageway and valve unit for providing water and two or more passageways and valve units for providing concentrates. These versions of the invention would thus be used to provide beverages formed out of different concentrates, or a combination of concentrates, and a single valve unit for dispensing water (carbonated or noncarbonated).

Similarly, another embodiment of the invention may be designed with a single passageway and valve unit for providing a single concentrate and either one or two water passageways and valve units. This particular version of the invention is useful for providing a dispensing head 20 capable of dispensing a beverage formed from a concentrate and a mixture of carbonated and/or non carbonated water. This embodiment is illustrated in greater detail in FIGS. 5, 14-17. It should be understood that most of the elements in the embodiment of the single concentrate valve body 132 are in most respects identical to those of the double valve body 32 of FIGS. 5-8, and thus the identical elements will not be described in great detail to avoid repetition. For example, the water head 76 is shown providing a seat for the syrup head 178 and has two passages 86 and two inlet openings 88, although variable numbers may be utilized as described above.

The main difference, however, lies in the syrup head 178, which includes only one single cylindrical shaped stem 182 with a single bore 184. An O-ring 85 is disposed to provide a sealing connection of the stem 182 to the plate 30, as does the embodiment illustrated in FIG. 3. To facilitate mixing of the concentrate ejected from the single bore 184, one or more (two are shown) angled diverted discharge openings 183 inject the syrup stream into the flow path of the base liquid, for example, depressurized carbonated water, that is flowing through the space defined by the circular head 106. Advantages of the two above-described dispensing heads are described in more detail below with reference to FIG. 18.

Still other versions of the invention may be provided with more fluid passageways and valve units than have been described above with respect to the illustrated embodiments.

It is anticipated that these alternative versions of the invention may be used to provide a means for forming a beverage from a combination of three or more different flavored concentrates, all discharged from a single nozzle.

Also, there is no requirement that the disclosed nozzle assembly be used in all versions of this invention or that the nozzle assembly only be used with versions of the invention capable of discharging plural concentrate and/or water streams. Similarly, it should be appreciated that the geometry of the water head discharge passage 86 may vary from that which is described and illustrated. There is no requirement that, in all versions of the invention, the passages 86 have a helical track. In some versions of the invention, the water head 76 may be formed so that the discharge passage 86 extends vertically downward. In other versions of the invention, the water head may be formed so that the discharge passage has a spiral or helical track. Similarly, the track of this discharge passage may subtend an arc of less or more than 180°, to permit fewer or more of the discharge passages 86 to extend through the main body 80. In another example, in multiple passageway systems, a first discharge passageway may extend in a linear path through the nozzle and a second discharge and/or third discharge passageway at least partially to curves around or surrounds the first discharge passageway.

Likewise, it should be appreciated that not all versions of the invention will include the curved, non-linear track, the flow path of discharge passage 86, which may take other forms besides a helical one. For example, an expanding spiral track may be implemented.

Also, the means of holding the dispensing head to the mounting block 28 and preventing leaks from the block when the head is disconnected may be employed in versions of the invention with less than the number of fluid passageways and valve units described in the primary embodiment.

Mechanisms other than the disclosed valve units 36-42 may be used to regulate fluid flow through the individual dispensing head passageways. For example, alternate embodiments (not shown) of the invention may even include mechanically actuated valves.

Similarly, valves other than the described poppet valves 114 may be fitted into the mounting block 28 to prevent flow out of passageways 112 when the dispensing head 22 is not attached. For example, a single valve plate may have individual valve members that separately control the fluid flows in the passageways in which they are mounted. In these versions of the invention, the dispensing head 22 may have a single post that, upon the coupling of the head to the mounting block 28 causes the valve plate to move the valve members from the closed to the open positions.

Figure 18:
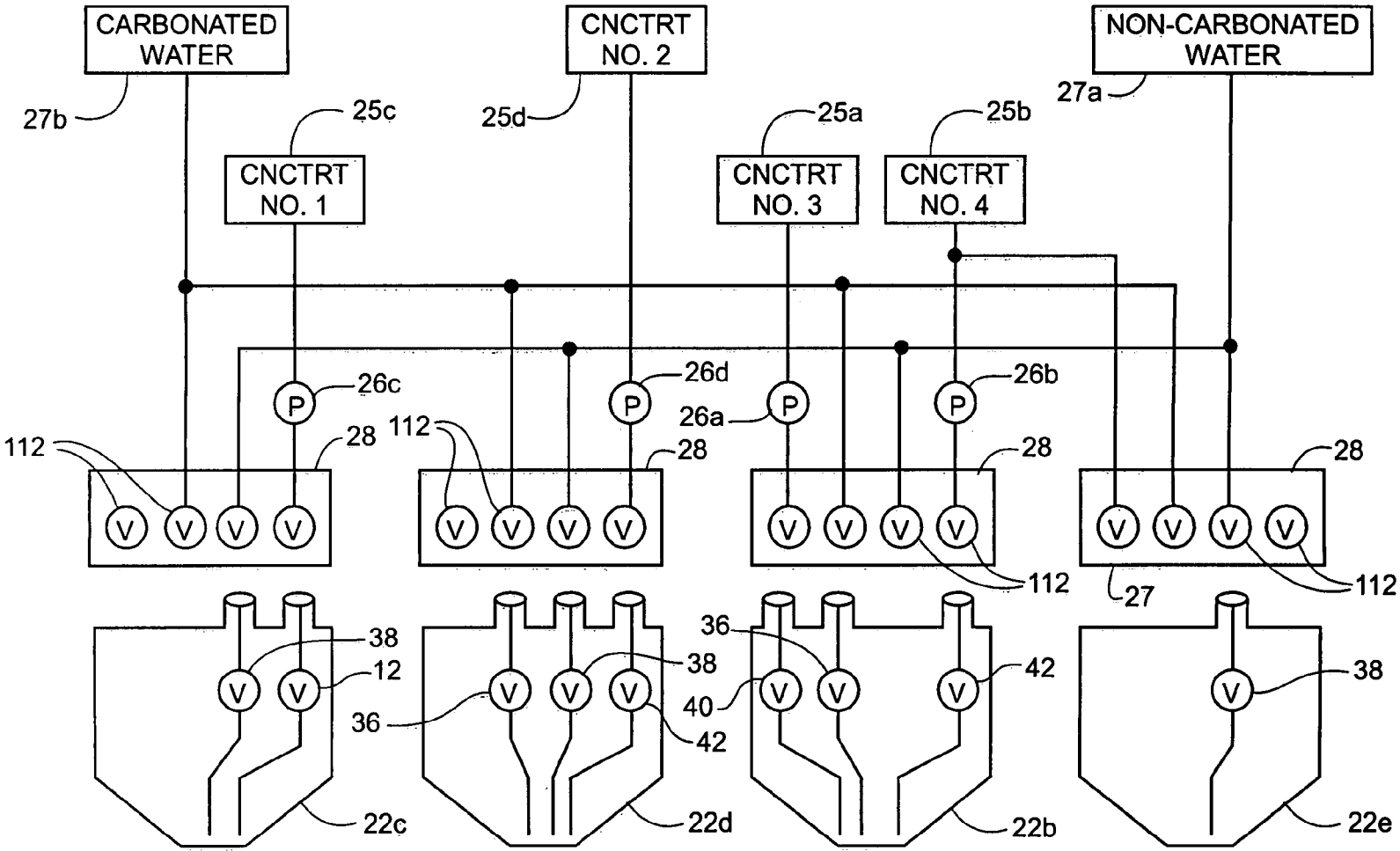
FIG. 18 is a schematic flow diagram illustrating how the system of this invention, once installed, supplies beverages made of different combinations of base liquids.

However, it is anticipated that, in most versions of the invention, it is preferred that the mounting block valves operate independently of each other and that each valve only open when a specific dispensing head valve actuating member couples with the mounting block 28. A further advantage of this version of the invention is that there may be circumstances when it is desirable to provide a dispensing head 22 with fewer conduits than there are mounting block passageways 112. For example, one could thus provide a dispensing system 20 of this invention as seen in FIG. 18 with plural mounting blocks 28 each of which has three or more passageways 112. A first one of the passageways 112 is dedicated to providing concentrate. The second and third passageways 112 are dedicated to, respectively, providing carbonated and noncarbonated water. In the system of FIG. 18, a fourth passageway 112, used to provide a second concentrate to the mounting block 28, is shown.

Then, depending on the specific beverage or beverages to be dispensed, a specific dispensing head 22*a-e* is attached to the mounting block 28. For example, if it is desirable to dispense only a highly carbonated beverage or beverages from a particular mounting block, a head 22*b* with only connections to the concentrate or concentrates and the carbonated water mounting block passageways 112 is attached. Alternatively, if it is desirable to dispense only a noncarbonated beverage from a particular mounting block 28, a head 22*c* with only connections to the concentrate and noncarbonated water mounting block passageways 112 is attached. When either of these dispensing heads 22*b* or 22*c* is attached to a mounting block 28, since neither head has the boss associated with the unused water stream, the mounting block poppet valve 114 associated with the passageway 112 for the unused water stream is not opened.

Lightly carbonated beverages may be provided by attaching dispensing head 22*d*. Dispensing head 22*d* has connections to both the noncarbonated and carbonated water supplies 27*a* and 27*b*, respectively, and the appropriate reservoir 25*d* containing concentrate, as shown. Water may be dispensed from the illustrated system 20 by attaching dispensing head 22*e*. Dispensing head 22*e* only has a connection to the noncarbonated water supply 27*a*.

An advantage of this version of the invention is that at installation, each mounting block is connected to both the noncarbonated and carbonated water supplies 27*a* and 27*b*, respectively. Water from each of these supplies only flows through the specific mounting block 28 or blocks through which the specific type of water is to be discharged. Consequently, following installation of the system 20 of this invention, one could change the type of beverage that is discharged from a particular mounting block 28 by simply changing the type of dispensing head attached to the block. The need to reset the water supply connections to the mounting block 28 is thus eliminated. This, and the fact the dispensing heads 22*a-e* are easily removed from and reattached to a mounting block, make it very simple to change the dispensed beverages based on changes in customer preference once system 20 is installed.

It should be apparent this feature allows the system to likewise be used to provide different concentrates to the mounting blocks 26 and to regulate their use based on the attached dispensing heads. Thus, as seen in FIG. 18, the system is initially designed to provide concentrate from reservoir 25*b* (for example, CONCENTRATE NO. 4) to the two rightmost mounting blocks 28. As illustrated, this concentrate is only discharged through dispensing head 22*b*. If there is increased customer demand for the beverage formed from the concentrate in reservoir 25*b*, the depicted dispensing head 22*e* is replaced with a head 22*b* that allows connection to the reservoir 25*b* containing that concentrate and to the companion carbonated water source 27*b*.

Clearly, a further advantage of this construction of the invention is that if a particular dispensing head is not used to dispense a particular fluid stream or streams, the cost of providing the valve unit or valve units needed to regulate these fluid stream or streams is eliminated.

Moreover, it likewise should be appreciated from FIG. 18 that the concentrate in a single container can be used to contribute to the formation of different beverages, depending on the beverage desired by the consumer. For example, the concentrate in container 25*b* may be of a beverage that serves as a supplemental flavor, such as cherry flavoring. Container 25*b* can then be connected to the mounting blocks 28 to which dispensing heads 22*b* and 22*d* are attached. Then, by selective discharge of the supplemental flavoring, it would be possible to selectively discharge a first beverage with supplemental cherry flavoring from head 22*b* and a second beverage with supplemental flavoring from head 22*d*. This feature of the invention thus makes it possible to provide supplemental flavored beverages without having to provide numerous additional containers that contain already mixed combinations of base beverage and supplemental flavoring.

Therefore, it is an object of the appended claims to cover all variations and modifications that come within the true spirit and scope of this invention, as described and illustrated in the above embodiment, and equivalents thereof. However, the above description is to be considered only illustrative and not limiting, the invention being only limited by the following claims and equivalents thereof.

What is claimed is:

1. A beverage dispensing head including:

a valve body that defines a first passageway for receiving a first fluid stream, a second passageway for receiving a second fluid stream, and a third passageway for receiving a third fluid stream, wherein each of the first passageway, the second passageway, and the third passageway are separate from one another;

first, second, and third independently actuated valves attached to the valve body, the first valve positioned to regulate fluid flow through the first passageway, the second valve positioned to regulate fluid through the second passageway, and the third valve positioned to regulate fluid flow through the third passageway; and a nozzle attached to the valve body, the nozzle shaped to have a first discharge passage through which a fluid stream from the first passageway is discharged, a second discharge passage that at least partially surrounds the first discharge passage, the second discharge passage having an inlet opening for receiving the fluid stream from the second passageway and an outlet opening through which the fluid stream is discharged and further shaped to have a cross-sectional area that increases from the inlet opening to the outlet opening, and a third discharge passage that at least partially surrounds the first discharge passage and the third discharge passage has an inlet opening spaced from the second discharge passage inlet opening for receiving the fluid stream from the valve body third passageway and an outlet opening spaced from the second discharge passage outlet opening through which the fluid stream is discharged and is shaped to have a cross-sectional area that increases from the inlet opening to the outlet opening.

2. The beverage dispensing head of claim 1, wherein the nozzle further comprises:

a first head with a body that defines the first discharge passage; and a second, ring-shaped head that defines the second and third discharge passages wherein the second ring-shaped head is seated around the first head.

3. A beverage dispensing head including:

a valve body defining first, second, and third passageways for receiving separate fluid streams, wherein each of the first passageway, the second passageway, and the third passageway are separate from each other;

first, second, and third independently actuated valves, wherein each of the first, second, and third independently actuated valves are attached to the valve body, the first valve positioned to regulate fluid flow through the first passageway, the second valve positioned to regulate fluid flow through the second passageway, and the third passageway positioned to regulate fluid flow through the third passageway; and a nozzle attached to the valve body, the nozzle shaped to have a first discharge passage through which a fluid stream from the first passageway is discharged, a second discharge passage that at least partially surrounds the first discharge passage, the second discharge passage having an inlet opening for receiving the fluid stream from the second passageway and an outlet opening through which the fluid stream is discharged and further shaped to have a cross-sectional area that increases from the inlet opening to the outlet opening, and a third discharge passage that is parallel to the first discharge passage through which a fluid stream from the valve body third passageway is discharged and the second discharge passage at least partially surrounds the third discharge passage.

4. A beverage dispensing head including:

a valve body defining a first, second, third, and fourth passageways for receiving separate fluid streams, wherein each of the first passageway, the second passageway, the third passageway, and the fourth passageway are separate from each other;

first, second, third, and fourth independently actuated valves attached to the valve body, the first valve positioned to regulate fluid flow through the first passageway, the second valve positioned to regulate fluid flow through the second passageway, the third valve position to regulate fluid flow through the third passageway, and the fourth valve positioned to regulate fluid flow through the fourth passageway; and a nozzle attached to the valve body, the nozzle shaped to have a first discharge passage through which a fluid stream from the first passageway is discharged, a second discharge passage that at least partially surrounds the first discharge passage, the second discharge passage having an inlet opening for receiving the fluid stream from the second passageway and an outlet opening through which the fluid stream is discharged and further shaped to have a cross-sectional area that increases from the inlet opening to the outlet opening, a third discharge passage that is parallel to the first discharge passage through which a fluid stream from the third passageway is discharged, wherein the second discharge passage at least partially surrounds the third discharge passage; and a fourth discharge passage that at least partially surrounds the first discharge passage and the third passage and the fourth discharge passage has an inlet opening spaced from the second discharge passage inlet opening for receiving the fluid stream from the fourth passageway and an outlet opening spaced from the second discharge passage outlet opening through which the fluid stream is discharged and that is further shaped to have a cross-sectional area that increases from the inlet opening to the outlet opening.

5. The beverage dispensing head of claim 4, wherein the nozzle is further shaped so that the first discharge passage and the third discharge passage open to the environment at a position forward of the second discharge passage outlet opening and the fourth discharge passage outlet opening to the environment.

6. A beverage dispensing head, including:

a first, a second, and a third passageway for receiving separate fluid streams, wherein each of the first passageway, the second passageway, and the third passageway are separate from each other;

first, second, and third independently actuated valves, the first valve positioned to regulate fluid flow through the first passageway, the second valve positioned to regulate fluid flow through the second passageway, and the third valve positioned to regulate fluid flow through the third passageway; and a nozzle shaped to have a first discharge passage through which a fluid stream from the first passageway is discharged, a second discharge passage that at least partially surrounds the first discharge passage, the second discharge passage having an inlet opening for receiving the fluid stream from the second passageway and an outlet opening through which the fluid stream is discharged and further shaped to have a cross-sectional area that increases from the inlet opening to the outlet opening, and a third discharge passage that at least partially surrounds the first discharge passage and the third discharge passage has an inlet opening spaced from the second discharge passage inlet opening for receiving the fluid stream from the third passageway and an outlet opening spaced from the second discharge passage outlet opening through which the fluid stream is discharged and is shaped to have a cross-sectional area that increases from the inlet opening to the outlet opening;

wherein the first discharge passageway extends in a linear path through the nozzle and the second discharge passage at least partially curves around the first discharge passage.

7. The beverage dispensing head of claim 6, wherein the nozzle further comprises:

a first head with a body that defines the first discharge passage; and a second, ring-shaped head that defines the second and third discharge passages wherein the second ring-shaped head is seated around the first head.

8. A beverage dispensing head, including:

a first, a second, a third, and a fourth passageway for receiving separate fluid streams wherein the first passageway is positioned to receive a first fluid stream, the second passageway is positioned to receive a second fluid stream, the third passageway is positioned to receive a third fluid stream; and the fourth passageway is positioned to receive a fourth fluid stream;

first, second, third, and fourth independently actuated valves, the first valve positioned to regulate fluid flow through the first passageway, the second valve positioned to regulate fluid flow through the second passageway, the third valve for regulating fluid flow through the third passageway, and the fourth valve for regulating fluid flow through the fourth passageway; and a nozzle shaped to have a first discharge passage through which a fluid stream from the first passageway is discharged, a second discharge passage that at least partially surrounds the first discharge passage, the second discharge passage having an inlet opening for receiving the fluid stream from the second passageway and an outlet opening through which the fluid stream is discharged and further shaped to have a cross-sectional area that increases from the inlet opening to the outlet opening, a third discharge passage that is parallel to the first discharge passage through which a fluid stream from the third passageway is discharged, wherein the second discharge passage at least partially surrounds the third discharge passage, and a fourth discharge passage that at least partially surrounds the first discharge passage and the third passage and the fourth discharge passage has an inlet opening spaced from the second discharge passage inlet opening for receiving the fluid stream from the fourth passageway and an outlet opening spaced from the second discharge passage outlet opening through which the fluid stream is discharged and that is further shaped to have a cross-sectional area that increases from the inlet opening to the outlet opening, wherein the first discharge passageway extends in a linear path through the nozzle and the second discharge passage at least partially curves around the first discharge passage.

* * * * *